United States Patent [19]

McClain, Jr.

[11] Patent Number: 4,795,195

[45] Date of Patent: Jan. 3, 1989

[54] DISCOUNT COUPON AND STAMP HOLDER

[76] Inventor: Brad A. McClain, Jr., 3714 Durness Way, Houston, Tex. 77025

[21] Appl. No.: 140,297

[22] Filed: Dec. 31, 1987

[51] Int. Cl.[4] ..... G09F 3/00; B42D 15/00; B42D 1/00; B42D 3/00

[52] U.S. Cl. ..... 283/56; 283/81; 281/3 R; 281/31

[58] Field of Search ..... 281/3 R, 22, 29, 31; 283/56, 63, 81

[56] References Cited

U.S. PATENT DOCUMENTS

| | | | |
|---|---|---|---|
| 470,861 | 3/1892 | Chichester | 281/3 R |
| 619,054 | 2/1899 | Strauss et al. | 283/81 |
| 938,910 | 11/1909 | Sultzer | 281/31 X |
| 3,718,348 | 2/1973 | Bellanca | 283/56 |
| 3,807,771 | 4/1974 | Greason | 283/56 |
| 3,995,741 | 12/1976 | Henderson | 283/81 |
| 4,305,605 | 12/1981 | Vine | 283/56 |
| 4,492,390 | 1/1985 | Jacobs et al. | 283/56 |
| 4,676,526 | 6/1987 | Redman | 283/81 |

*Primary Examiner*—Frank T. Yost
*Assistant Examiner*—Paul M. Heyrana
*Attorney, Agent, or Firm*—James A. Bargfrede

[57] ABSTRACT

A booklet is provided with a front cover having attached on the inside portion a conventional book of postage stamps. The pages of the booklet are perforated near the center of the booklet and the pages contain merchandise discount coupons for use by an individual who has purchased the booklet at less than the face value of the postage stamps contained in the postage stamp book attached to the cover.

3 Claims, 1 Drawing Sheet

DISCOUNT COUPON AND STAMP HOLDER

SUMMARY OF THE INVENTION

An article of manufacture is provided comprising a book having a front cover and a plurality of perforated pages bound together, for example, by a plurality of staples. On the inside portion of the front cover is attached a conventional book of postage stamps. Such book of postage stamps ordinarily is purchased from various sources for the face value of the postage stamps in the book. The article of manufacture of the present invention is sold for less than the face value of the postage stamps attached to the inside of the front cover. A plurality of perforated pages having discount coupons attached comprise the remainder of the booklet or article of manufacture of the present invention. The discount coupons may be redeemed for discounted priced merchandise or service while also allowing the purchaser of the booklet or article of manufacture of the present invention to obtain postage stamps at a price below the face value of such postage stamps. The combination of elements and pricing of the booklet or article of manufacture of the present invention are not thought to be known in the merchandising art, and thus the present invention provides a novel and useful article of manufacture for use in a novel and useful merchandising system.

DETAILED DESCRIPTION

Figure 1:
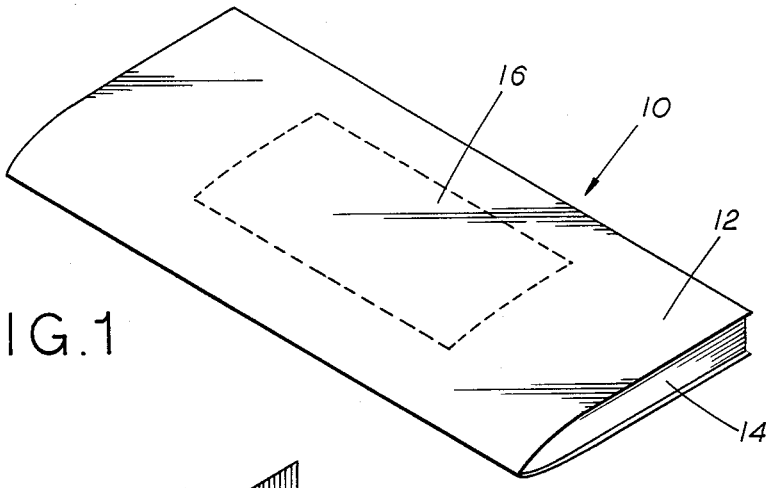
FIG. 1 is an isometric projection of the article of manufacture or booklet of the present invention showing the top of the front cover.

FIG. 1 is an isometric projection of the article of manufacture or booklet 10 of the present invention showing the front cover 12 and a plurality of pages 14 in the booklet 10. Booklet 10, for example, may be of the size of a well-known personal checkbook. The back portion 16 of a book of postage stamps is shown in broken lines on the inside of cover 12. The article of manufacture or booklet of the present invention ordinarily will be comprised of paper material with the cover 12 utilizing heavier paper than the pages 14 thereby making the booklet 10 more durable for use for an extended period of time. Obviously, the type and quality of paper or other material used to manufacture the booklet 10 may vary according to the circumstances and the merchandising desires of those who market and use the booklet 10 of the present invention. It will be further appreciated that a hard cover may be used in some instances where merchandising requirements dictate that a hard cover be utilized.

Figure 2:
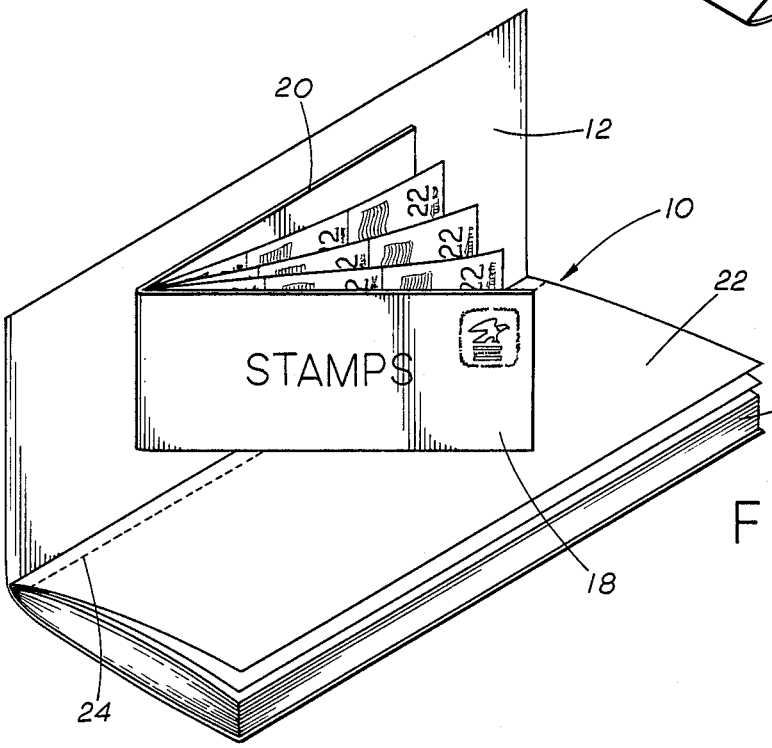
FIG. 2 is an isometric view showing the article of manufacture or booklet of the present invention with the front cover open to show the attached stamp book.

FIG. 2 is an isometric view of the article of manufacture or booklet 10 of the present invention showing front cover 12 in an open position with a stamp book 18 attached, for example, with glue 20 to the inside of front cover 12. Front Cover 12 obviously has an inside portion and an outside portion and the stamp book 18 is attached to the inside portion of cover 12 to allow easy removal of the stamps while providing protection from moisture such as rain. As pointed out previously, the stamp book 18 may be a conventional postage stamp book containing stamps having a face value, for example, of 22 cents for each stamp. A typical stamp book contains 20 stamps having a face value of 22 cents for each stamp and such booklet therefore normally is sold for $4.40 when purchased at facilities such those found at locations operated by the United States Postal System.

A plurality of pages 14 are positioned between the front cover and back cover of the booklet 10 of the present invention. A typical page 22 has perforations 24 near the top of each page to allow each individual page to be removed easily from the booklet when redeeming the discount coupon attached to each individual page at the time of purchase of a product or a service associated with such discount coupon. FIG. 2 does not show a discount coupon attached to page 22 but it will be apparent that the discount coupon can be attached to either side of page 22 in accordance with manufacturing and marketing requirements.

Figure 3:
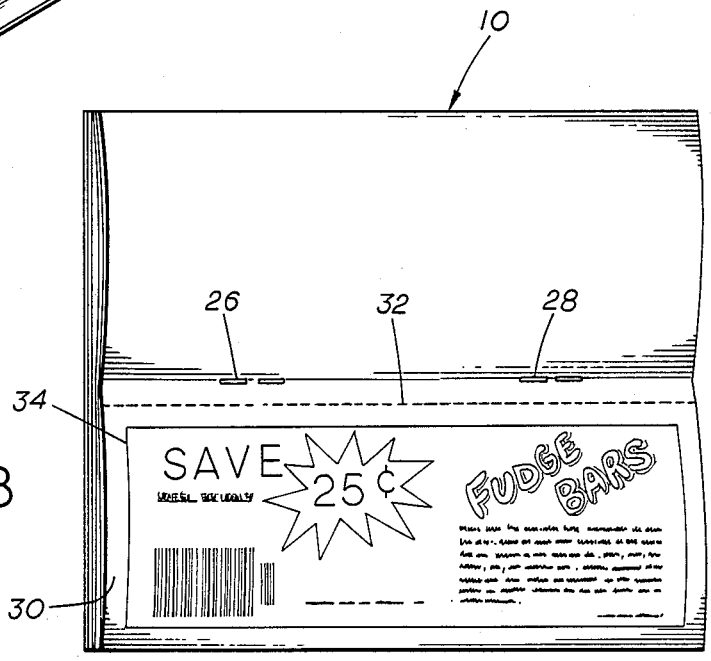
FIG. 3 is an oblique projection showing the article of manufacture or booklet of the present invention in an open position in the middle of such booklet.

FIG. 3 is an oblique projection of the article of manufacture or booklet 10 of the present invention shown in an open position in the middle of the book. Fasteners such as staples 26 and 28 may be used to attach the pages of the booklet to the cover. As mentioned previously, each page such as page 30 having perforations 32 allow easy removal of the pages from the booklet so that a discount coupon such as discount coupon 34 shown in FIG. 3 may be redeemed. Thus, discount coupon 34 may be attached to page 30. When a purchase is made involving the sponsor of the discount coupon 34, the entire page 30 may be easily removed because of the perforations 32 along the upper portion of page 30. As the pages are removed from the booklet, the user can visually note when another booklet soon will be required.

Thus, the present invention provides an article of manufacture or booklet which is new and novel and which is used in a new and novel manner with a conventional postage stamp book to increase the sales of products or services covered by discount coupons in such booklet. A book of postage stamps having a known face value is positioned inside of the front cover of the booklet so that such postage stamps may be removed easily as desired. Assembly of the pages of the booklet and the perforations on each page allow the user of the booklet to selectively, quickly, and reliably select a discount coupon for redemption upon purchase of a product or a service associated with such discount coupon.

Although a preferred embodiment of the invention has been shown and described in accordance with the requirements of the United States Patent Law, it will be appreciated by those skilled in the art to which the present invention pertains that modifications, variations, and improvements may be made without departing from the spirit of the invention defined by the claims.

I claim:

1. An article of manufacture for use in retail establishments which honor discount coupons from marketers, said article of manufacture including in combination cover means including a front page and a back page, a plurality of pages perforated along a line near the top of each page with each page having a discount coupon affixed thereto and fixedly attached to said cover means, and booklet means positioned in said cover means.

2. An article of manufacture defined by claim 1 wherein said booklet means comprises a book of conventional postage stamps to be sold at less than face value.

3. An article of manufacture including in combination cover means including a rectangular front page having an outside portion and an inside portion, a plurality of perforated pages each having a discount coupon and fastened to said cover means, and a book of postage stamps fixedly positioned on the inside portion of said rectangular front page.

* * * * *